US006848971B2

(12) United States Patent
Doman

(10) Patent No.: US 6,848,971 B2
(45) Date of Patent: Feb. 1, 2005

(54) ELECTRONIC BEVEL ANGLE INDICATOR FOR A HOLLOW GRINDER

(76) Inventor: David Burke Doman, 3524 Crescent Hill Rd., Springfield, OH (US) 45502

( * ) Notice: Subject to any disclaimer, the term of this patent is extended or adjusted under 35 U.S.C. 154(b) by 58 days.

(21) Appl. No.: 10/395,599

(22) Filed: Mar. 24, 2003

(65) Prior Publication Data

US 2004/0266318 A1 Dec. 30, 2004

(51) Int. Cl.[7] ..... B24B 49/00

(52) U.S. Cl. ..... 451/5; 451/9; 451/241; 451/410; 451/234; 451/545

(58) Field of Search ..... 451/5, 6, 8, 9, 451/10, 11, 241, 340, 364, 367, 369, 410, 405, 414, 420, 234, 231, 545

(56) References Cited

U.S. PATENT DOCUMENTS 5,172,484 A * 12/1992 Triola ..... 33/534
5,839,943 A * 11/1998 Stadtfeld ..... 451/8
6,325,697 B1 * 12/2001 Gottschalk ..... 451/5
6,379,218 B1 * 4/2002 Bailer et al. ..... 451/8
6,381,862 B1 * 5/2002 Doman ..... 33/630
6,575,812 B2 * 6/2003 Wirz ..... 451/9

* cited by examiner

*Primary Examiner*—Joseph J. Hail, III
*Assistant Examiner*—Hadi Shakeri
(74) *Attorney, Agent, or Firm*—Mark A. Navarre

(57) ABSTRACT

An electronic hollow grinder bevel angle indicator wherein a microprocessor calculates the grinding bevel angle that will be obtained when a tool is placed flat upon a tool rest and presented to the periphery of a rotating grinding wheel. The calculated bevel angle is the acute angle of intersection between the tool rest plane and a plane tangent to the grinding wheel periphery at the line of intersection between the grinding wheel periphery and the tool rest plane. The microprocessor also calculates the air-gap between the tool rest and grinding wheel, and warns the operator when the air gap exceeds a specified safety threshold.

6 Claims, 7 Drawing Sheets

ELECTRONIC BEVEL ANGLE INDICATOR FOR A HOLLOW GRINDER

TECHNICAL FIELD

This invention pertains to hollow grinding machines, and more particularly to an electronic device that calculates and displays the bevel angle that will be ground upon a tool, using sensor measurements of the tool rest position and orientation.

BACKGROUND OF THE INVENTION

Hollow grinders are commonly used for sharpening tool blades, and typically include a tool rest for maintaining a desired orientation of the blade relative to the grinding wheel. This orientation determines the grinding or bevel angle with respect to the longitudinal axis of the tool blade.

The tool rest is typically adjustable with two or more degrees of freedom to facilitate adjustment of the height and attitude of the tool blade, while maintaining a sufficiently small air gap between the tool rest and the grinding wheel to prevent operator injury. Simultaneously achieving a desired bevel-angle and air-gap can be both difficult and time consuming, and most hollow-grinding machines have no mechanism for determining the bevel angle that will be achieved with a given setting of the tool rest. Furthermore, the bevel angle varies with the radius of the grinding wheel, which decreases with use. My prior U.S. Pat. No. 6,381,862, issued on May 7, 2002, discloses a bevel angle indicator utilizing a novel tool rest support mechanism that maintains a prescribed and coordinated height-attitude relationship of the tool rest with respect to the grinding wheel axis, and a pointer that can be adjusted according to the radius of the grinding wheel. However, it would be advantageous from a cost standpoint to utilize a more conventional tool rest support mechanism, and in many applications, a digital readout of the bevel angle is desired.

SUMMARY OF THE INVENTION

The present invention is directed to an improved bevel angle indicator for a hollow grinding machine that utilizes a conventional tool rest adjustment mechanism, and that detects the position of the adjustment mechanism for purposes of calculating and displaying the bevel angle that will be achieved when a tool is placed flat on the tool rest and presented to the periphery of a rotating grinding wheel. The grinding wheel radius may be sensed or directly entered through a user interface. The calculated bevel angle is the acute angle of intersection between the tool rest plane and a plane tangent to the grinding wheel periphery at the line of intersection between the grinding wheel periphery and the tool rest plane. Additionally, the indicator of this invention determines the air-gap between the tool rest and grinding wheel, and warns the operator when the air gap exceeds a specified safety threshold.

DESCRIPTION OF THE PREFERRED EMBODIMENT

Figure 1:
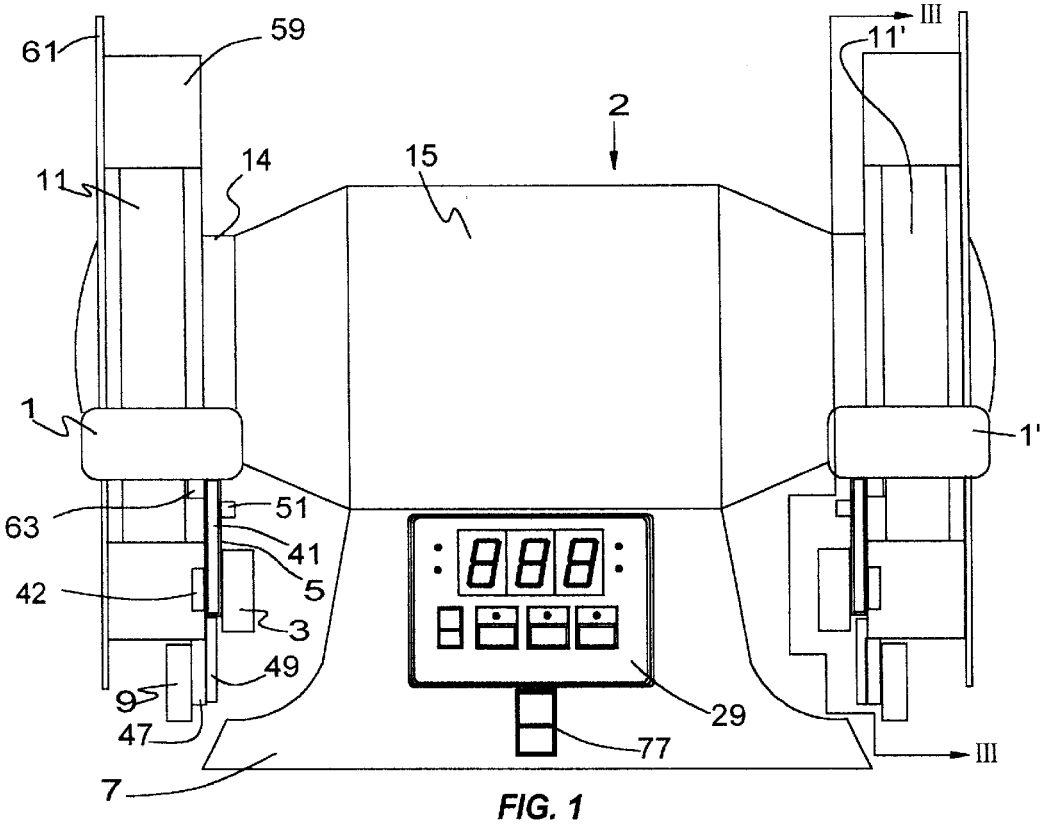
FIG. 1 is a frontal view of a hollow grinder equipped with the bevel angle indicator of the present invention, including a microprocessor-based display unit.
Figure 2:
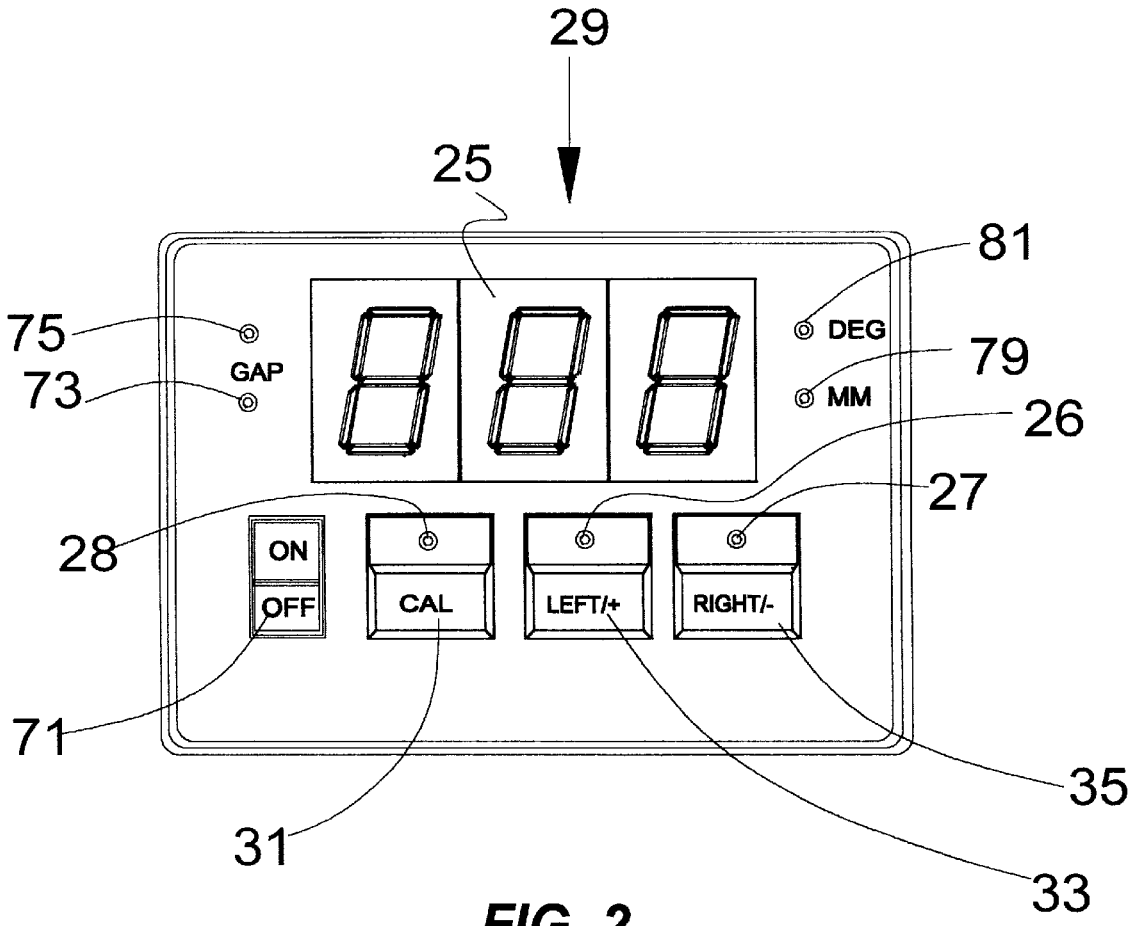
FIG. 2 is a frontal view of the display unit of FIG. 1.
Figure 3:
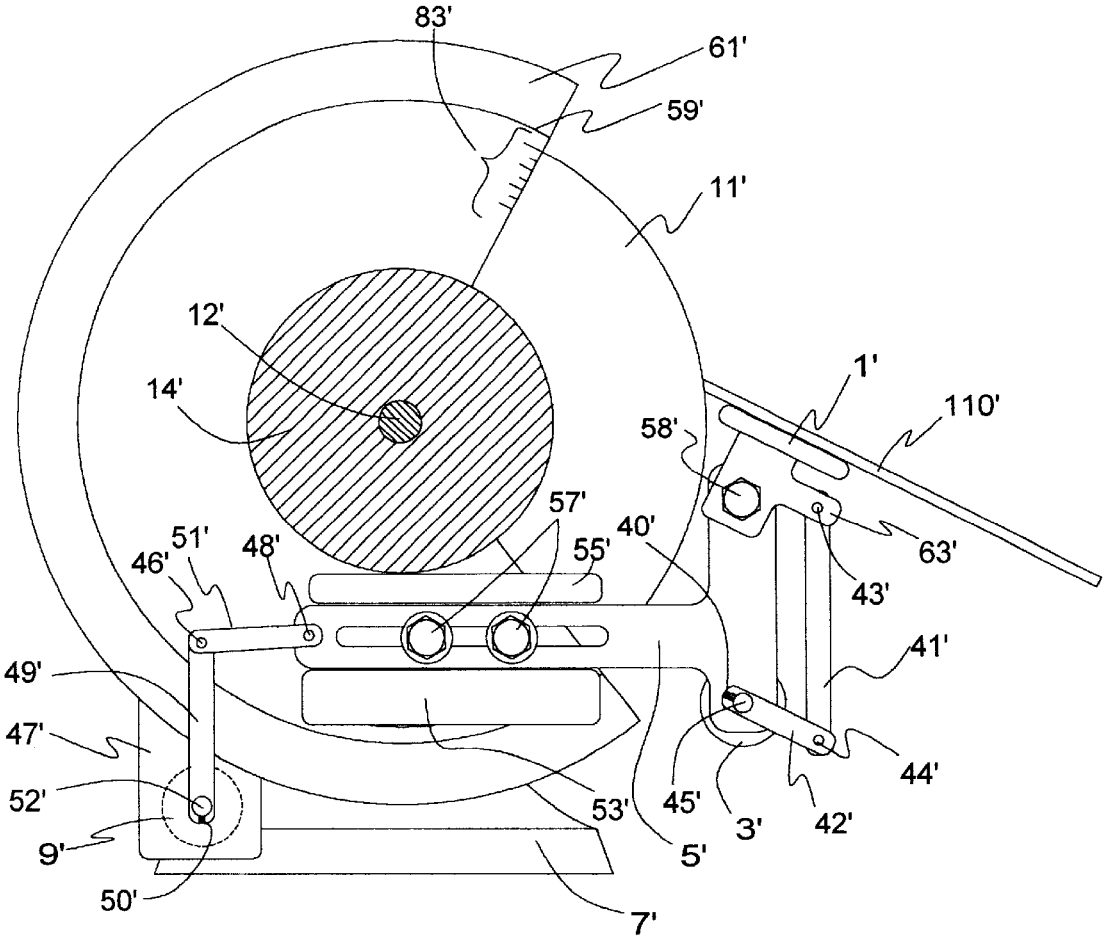
FIG. 3 is a partial sectional view of the hollow grinder of FIG. 1, taken along the line A—A depicted in FIG. 1.

Referring to the drawings, and particularly to FIGS. 1–3, the present invention is illustrated in the context of a hollow bench grinder 2 having left-hand and right-hand grinding wheels 11, 11' mounted on an arbor 12 that is powered by an electric motor 15. Since the left-hand and right-hand sides of grinder 2 are similarly constructed and equipped, the following description applies to both left-hand and right-hand sides even though the reference numerals have been omitted in FIG. 1 for the right-hand side. In cases where a reference numeral is used to designate a component associated with the right-hand side of the grinder 2, the number is primed to distinguish it from the corresponding component on the left-hand side.

As seen in FIGS. 1 and 3, a shroud 59 and an end-plate 61 supported on the motor end housing 14 partially enclose grinding wheel 11 to capture sparks and grinding debris. Upper plate 55 and lower plate 53 are attached to shroud 59 to serve as guides that ensure that a tool rest support 5 can translate along a line parallel to the ground plane without rotating. A tool rest 1 is attached to tool rest support 5 via a bolt 58. Tool rest 1 can rotate about the longitudinal axis of bolt 58 to change the angular orientation of said tool rest's working surface. Bolts 57 are tightened to restrict linear translation of tool rest support 5 while the grinder is operating. Bolts 57 are loosened to enable linear translation of tool rest support 5 in order to adjust the linear position of tool rest 1. Tool rest pitman arm 63 is connected to coupler bar 41 via a rivet 43. Coupler bar 41 is connected to idler arm 42 via rivet 44. Idler arm 42 is rigidly coupled to a shaft 45 of a rotary potentiometer 3 via setscrew 40. Tool rest support 5 is connected to a linkage arm 51 via rivet 48. Linkage arm 51 is connected to linkage arm 49 via rivet 46. Linkage arm 49 is rigidly coupled to a shaft 52 of a rotary potentiometer 9 via setscrew 50. Potentiometer 3 is mounted on the tool rest support 5, and potentiometer 9 is mounted on a support bracket 47 attached to shroud 59. Potentiometers 9 and 3 are connected to a display unit 29 via insulated copper wires (not shown).

Figure 4:
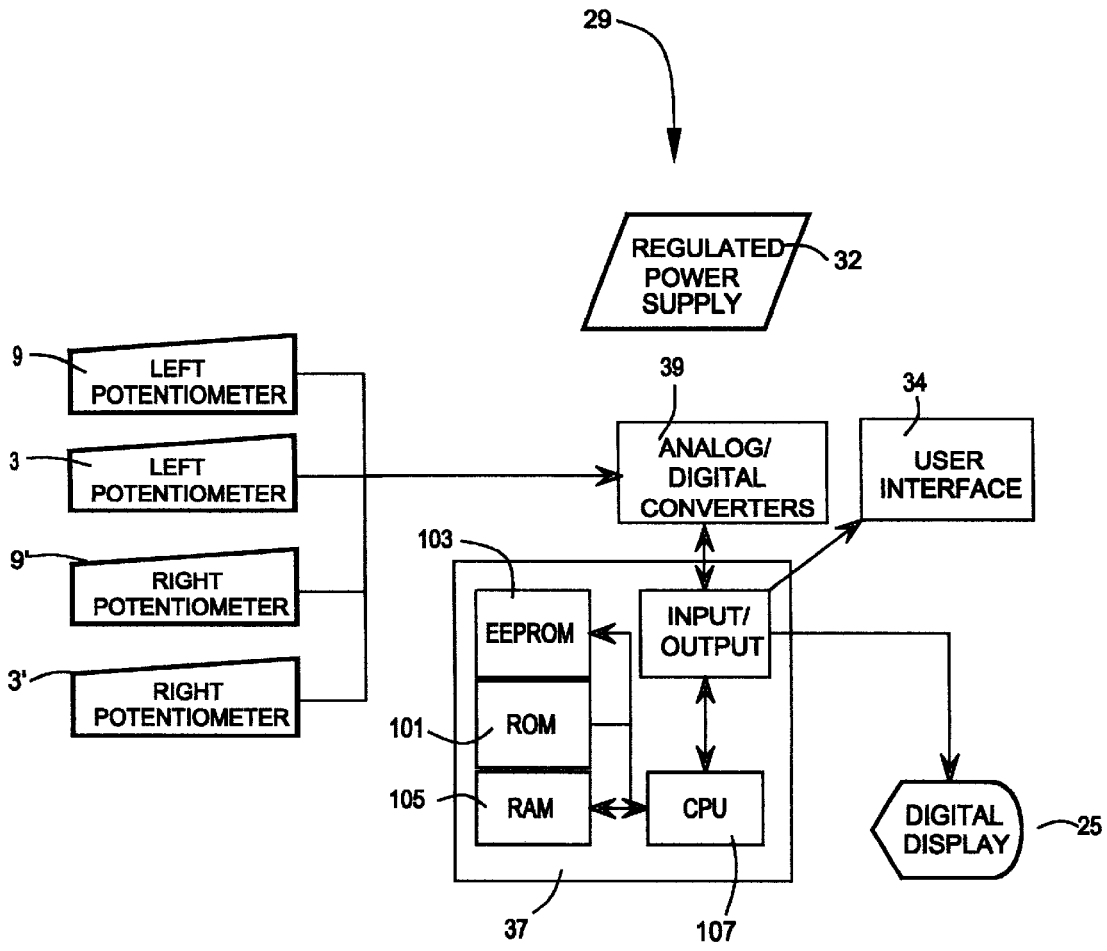
FIG. 4 is a functional block diagram of the display unit of FIGS. 1 and 2.

As depicted by the block diagram of FIG. 4, the display unit 29 houses a regulated power source 32 for the potentiometers 3, 3', 9, 9' and a number of other components including an analog-to-digital converter unit 39, a microprocessor 37, a user interface 34, and a digital display 25. The analog-to-digital converters 39 convert voltages from the potentiometers 3, 3', 9, 9' into 10-bit binary numbers that are uniquely correlated to the linear position of tool rest support 5 and the angular orientation of the working surface of tool rest 1. Microprocessor 37 stores a computer program in read-only-memory (ROM) 101 that is executed by central processing unit (CPU) 107 to calculate the bevel angle that will be achieved when a tool 110 is placed flat on the working surface of tool rest 1 and presented to the periphery of grinding wheel 11. The bevel angle is displayed on digital display 25 in units of degrees. The user interface 34 includes a number of pushbuttons 31, 33, 35, and allows the grinder operator to switch operating modes.

Referring to FIG. 2, pushbutton 31 is used to toggle between a calibration mode and bevel angle display mode. LED 28 is illuminated when display unit 29 is in the calibration mode. Pressing pushbutton 33 in bevel angle display mode causes LED 26 to illuminate and the digital display 25 to display the bevel angle that will result when a tool 110 is placed flat on the working surface of left-hand tool rest 1 and presented to grinding wheel 11. Similarly, pressing pushbutton 35 while in bevel angle display mode illuminates LED 27 and causes the digital display 25 to display the bevel angle that will result when a tool 110 is placed flat on the working surface of right-hand tool rest 1' and presented to grinding wheel 11'. When the digital display 25 operates in bevel angle display mode, LED 81 is illuminated to indicate that the unit is displaying bevel angle in units of degrees. A green LED 75 is illuminated when the air gap between the leading edge of the tool rest 1 and the periphery of the grinding wheel 11 is less than or equal to a specified maximum safe distance. The air gap is a derived measurement that is computed by microprocessor 37, based upon known fixed tool rest geometry and sensor measurements. Similarly a red LED 73 is illuminated when the air gap exceeds the specified maximum safe distance.

When display unit 29 operates in calibration mode, LED 28 illuminates, air gap LEDs 75 and 73 are turned off, and LED 79 illuminates to indicate that digital display units are in millimeters. In calibration mode, digital display 25 indicates the radius of the left or right grinding wheel 11, 11'. The LEDs 26 and 27 indicate which wheel radius is being displayed, while pushbuttons 33 and 35 increment and decrement the wheel radius shown on digital display 25. The user cannot switch wheels when in calibration mode; wheel selection must occur before entering calibration mode. When the user has manipulated pushbuttons 33 and 35 so that digital display 25 displays the correct wheel radius, the user can switch back to bevel angle display mode by pushing pushbutton 31. As seen in FIG. 3, indicia 83 are printed on shroud 59 to assist the user in measuring the radius of grinding wheel 11'. The user simply places a straight-edge on the wheel periphery and reads the wheel radius from the indicia 83 at the point where the straight edge and index line intersect. An alternative embodiment could use a slide potentiometer in place of the scale to convert wheel radius measurements into an electrical signal that is processed by display unit 29 in a manner similar to the signals from potentiometers 3, 3', 9, 9'. All pushbuttons and LEDs interface with microprocessor 37. Switch 71 turns display unit 29 on and off, and switch 77 turns the grinder motor 15 on and off.

Figure 5:
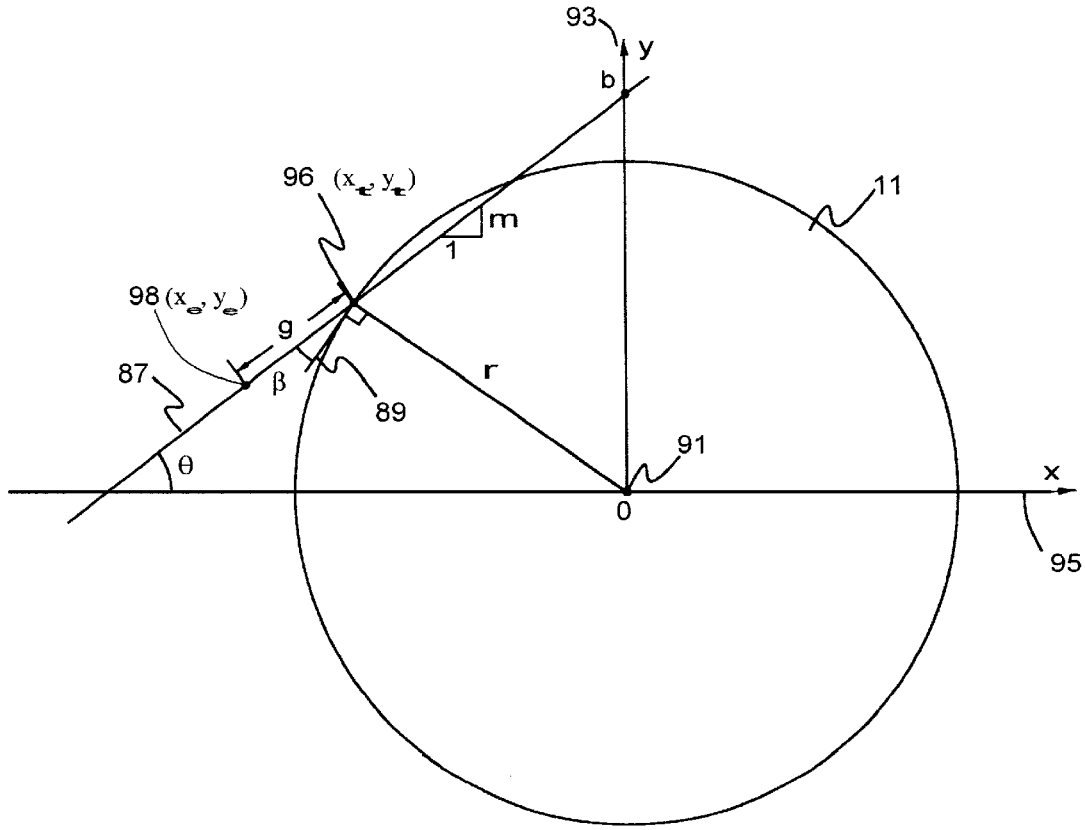
FIG. 5 is an idealized model of the grinder of FIG. 1, including the grinder wheel and tool rest.

FIG. 5 shows an idealized model of the tool rest and grinding wheel geometry. The grinding or bevel angle β is defined as the acute angle of intersection between two planes: a plane 87 that is coincident with the working surface of tool rest 1, and a plane 89 that is tangent to the periphery of grinding wheel 11 at the line of intersection between plane 87 and grinding wheel 11. FIG. 5 shows a two dimensional cross-section of these planes; thus, without loss of generality, the planes are shown as lines, and lines parallel to the axis of rotation of grinding wheel 11 are shown as points. A right-handed Cartesian coordinate system is defined by an origin 0 (point 91) at the grinding wheel axis of rotation, an x-axis 95 parallel with the ground-plane that supports grinder 2, and a y-axis 93 perpendicular to such ground-plane. The line representing plane 87 can be written in slope-intercept form as y=(m*x)+b, where x and y are Cartesian coordinates referenced from the origin O, m is the slope of the line with respect to the x-axis 95, and b is the y-intercept of the line. One formulation for the bevel angle β is given by:

$$\beta = \arccos\left(\frac{y_t}{r}\cos\theta - \frac{x_t}{r}\sin\theta\right) \tag{1}$$

where the point 96 ($x_t$, $y_t$) is the point of intersection between the periphery of grinding wheel 11 and the plane 87, r is the radius of said grinding wheel and θ=arctan(m). The x-coordinate of the point 96 is given by:

$$x_t = \frac{-2mb - \sqrt{4m^2b^2 - 4(m^2+1)(b^2-r^2)}}{2(m^2+1)} \tag{2}$$

while the y-coordinate of the point 96 is given by:

$$y_t = mx_t + b \tag{3}$$

Figure 6:
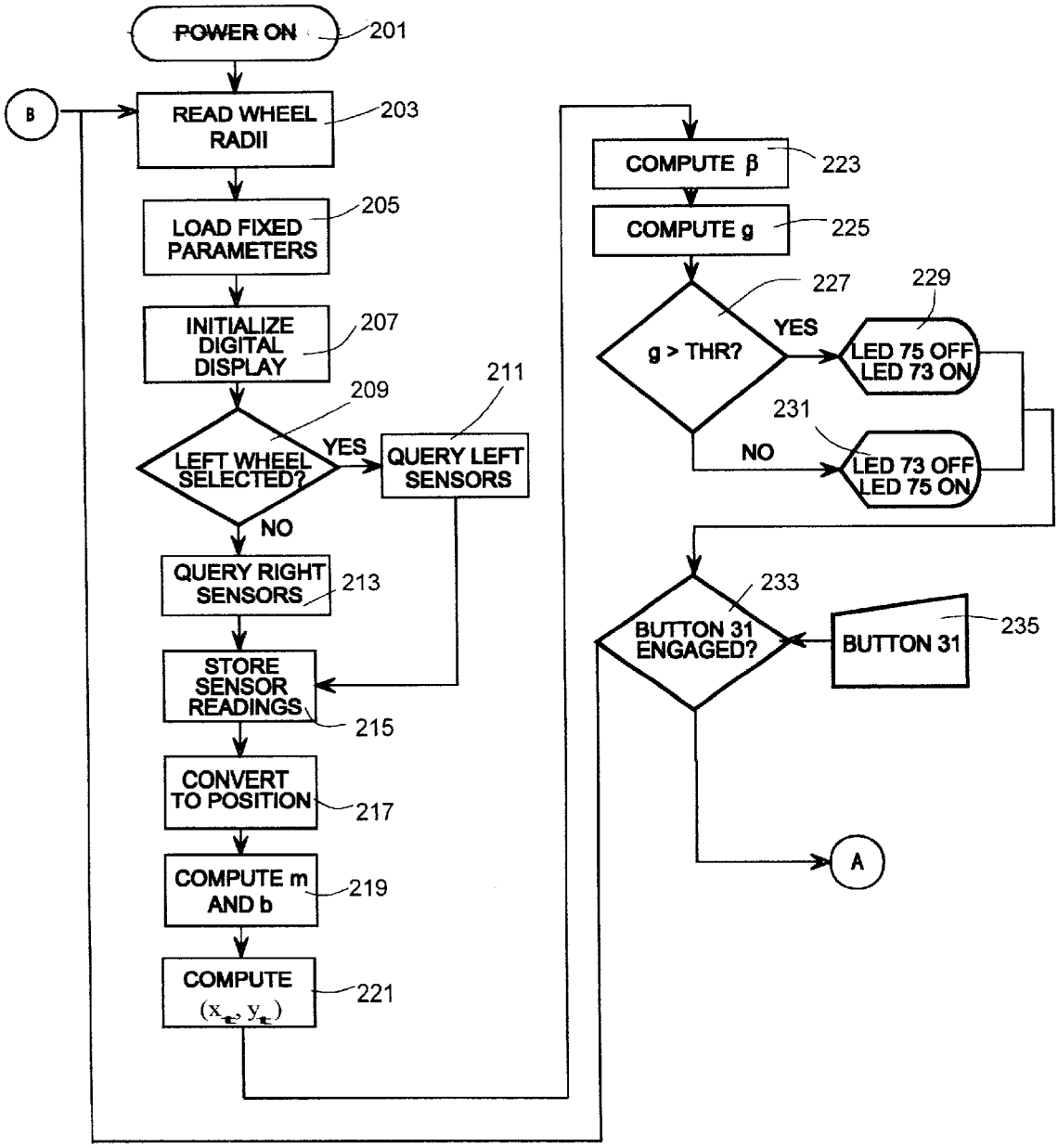
FIG. 6 is a flowchart that describes a software routine executed by the display unit of FIG. 1.
Figure 7:
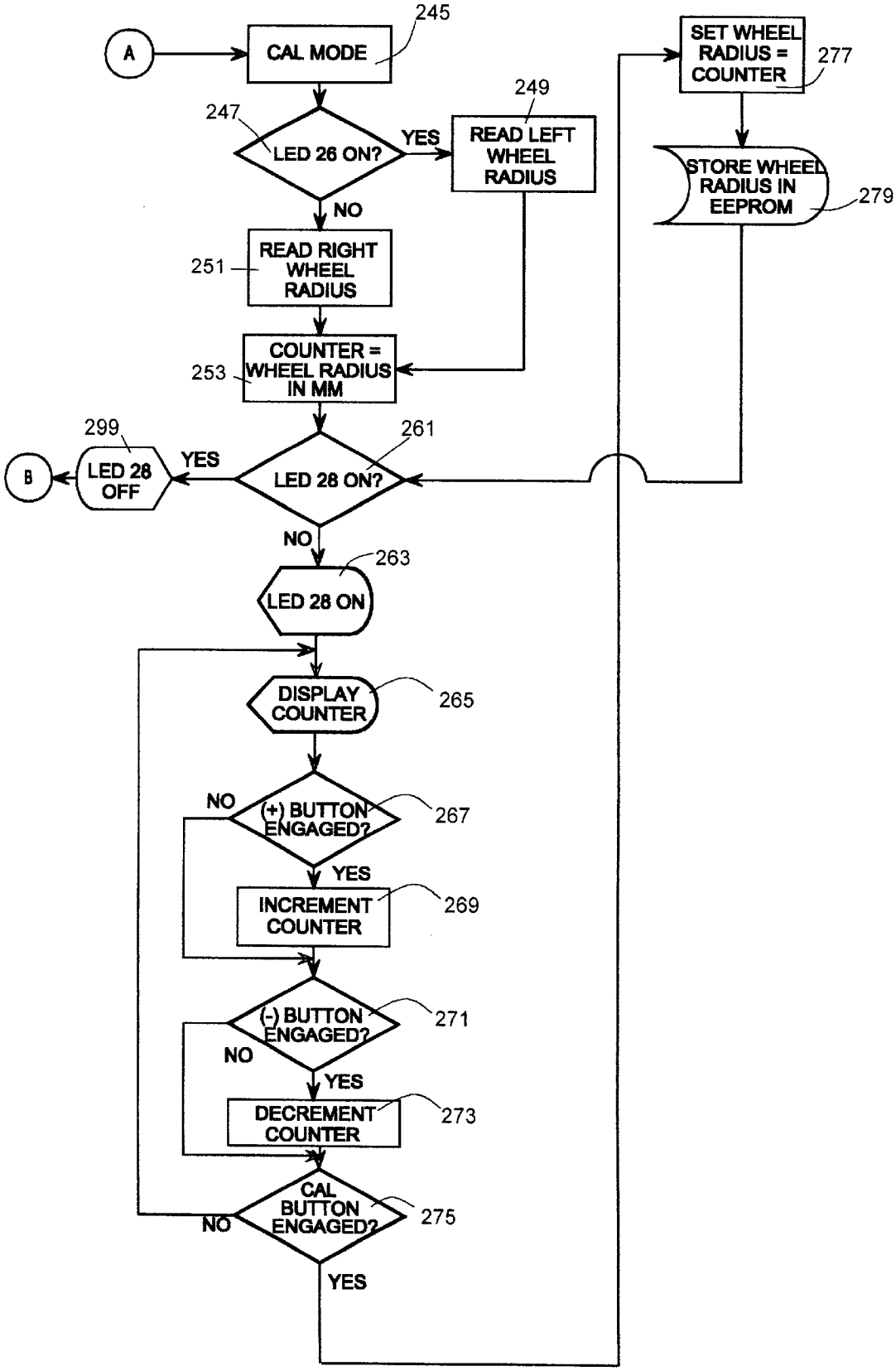
FIG. 7 is a flowchart that describes the operation of an interrupt service routine executed by the display unit of FIG. 1 to allow operator modification of the grinder wheel radius.

The flowcharts shown in FIGS. 6 and 7 describe the operations that are carried out by microprocessor 37. Microprocessor 37 is responsible for processing sensor measurements, carrying out all computations, handling user input and driving the digital display 25. The main routine is shown in FIG. 6 while FIG. 7 describes an interrupt service routine (ISR) that is used to handle user input and display output when the user wishes to manually update the grinding wheel radii. Note that the ISR can halt the execution of the main routine at any point in the flowchart in FIG. 6 when the user pushes the CAL mode button 31.

Referring to FIG. 6, block 201 designates power-up of the CPU 107 when the user turns on switch 71. The most recent values of wheel radii are read from non-volatile Electrically Erasable Programmable Read Only Memory (EEPROM) 103, as indicated at block 203. Fixed geometric parameters are loaded into Random Access Memory (RAM) 105 at block 205; such parameters specify the dimensions and relative locations of tool rest 1 and tool rest support 5 as well as the sensor calibration parameters. Block 207 initializes the digital display 25 in the bevel angle display mode, and block 209 determines which grinding wheel has been selected. The blocks 211, 213, 215 and 217 are then executed to obtain and store the sensor readings for the selected grinding wheel, and to convert the stored readings into physically meaningful floating point measurements of tool rest position and attitude using empirically derived calibration curves. The block 219 then computes the slope and y-intercept of the line representing the tool rest plane 87, based on the fixed geometric parameters and sensor measurements. For example, the reading of potentiometer 3 provides the angle θ of the tool rest 1 with respect to the x-axis 95, the slope m of the plane 87 is tan(θ), and the readings of potentiometers 3 and 9 provide the y-intercept b. The coordinates ($x_e$, $y_e$) of a point 98 on the front edge of the tool rest 1 are also determined at this time based on the fixed geometric parameters. The intersection point 96 of the tool rest plane 87 and grinding wheel periphery is then calculated at block 221 using Equations (2) and (3). The grinding or bevel angle β is then calculated at block 223 using Equation (1). Finally, the block 225 calculates the air gap g between the front edge of the tool rest 1 and grinding wheel 11 using the expression:

$$g = \sqrt{(x_t - x_e)^2 + (y_t - y_e)^2} \tag{4}$$

In other words, the air gap g is defined as the distance between points 98 and 96, as shown in FIG. 5. The blocks 227, 229 and 231 determine if the air gap g exceeds a specified safety threshold, turn on the green LED 75 if the air gap is does not exceed the threshold, and turn on the red LED warning light 73 if the air gap does exceed the threshold. If at any time the user presses CAL button 31, as indicated at blocks 235, the block 233 is answered in the affirmative, and the ISR of FIG. 7 is called to permit adjustment of the wheel radii stored in EEPROM 103.

Referring to FIG. 7, the calibration mode is entered at block 245, which turns on the LED 79 to reflect that the left or right wheel radius will be displayed in units of millimeters. Then block 247 determines which grinding wheel is selected, as indicated by the state of LEDs 26 and 27 when the CAL button 31 is depressed. If LED 26 is illuminated, then the user can change the radius of the left-hand wheel 11, and block 249 reads the most recent radius of the left-hand wheel 11 from EEPROM 103. If LED 27 is illuminated, then the user can change the radius of the right-hand wheel 11', and block 251 reads the most recent radius of the right-hand wheel 11' from EEPROM 103. The block 253 then stores the respective wheel radius value in an integer counter variable (Counter). The blocks 261 and 263 turn on the calibration mode LED 28 to indicate that the display unit 29 is in calibration mode and to indicate that the function of buttons 33 and 35 have changed from wheel selection buttons to increment and decrement buttons. The block 265 causes the value of the counter variable to be displayed on the digital display 25. If the user presses button 33, as determined at block 267, the block 269 increments the displayed counter variable by 1. If the user pressed button 35, as determined at block 271, the block 273 decrements the displayed counter variable by 1. If the user presses the calibration button 31, as determined at block 275, the blocks 277 and 279 set the wheel radius equal to the counter variable and store its value in non-volatile EEPROM 103, whereafter the blocks 261 and 299 turn off the calibration mode LED 28, completing the calibration mode ISR.

While the present invention has been described in reference to the illustrated embodiments, it is expected that various modifications in addition to those mentioned above will occur to those skilled in the art. For example, there are many types of angular and linear position sensors that could be employed to characterize the tool rest plane. Furthermore, many variants of tool rest support mechanisms can be found on hollow grinding machines. The method and apparatus described herein can be used to determine tool bevel angles for any hollow grinding machine that is equipped with a mechanical tool rest, provided that it can be outfitted with sensors that allow one to characterize the tool rest plane. Automatic measurement of wheel radius could also be employed to eliminate the wheel calibration mode of the illustrated embodiment. Thus, it will be understood that mechanisms incorporating these and other modifications may fall within the scope of this invention, which is defined by the appended claims.

What is claimed is:

1. An electronic indicator for a hollow grinder including a circular grinding wheel supported about an axis of rotation, a tool rest having a working surface for supporting a tool blade with respect to a grinding surface of the grinding wheel, and a tool rest support mechanism positionable to adjust a height and an attitude of said tool rest with respect to said grinding surface, comprising:

sensor means for sensing a current position of said support mechanism;

a microprocessor responsive to said sensor means and a radius of said grinding wheel for mathematically characterizing a first plane including the working surface of said tool rest, and a second plane tangent to said grinding surface at an intersection between said first plane and said grinding surface, and for calculating an acute angle of intersection between said first and second planes; and an electronic display for displaying the calculated angle of intersection as an indication of an achieved bevel angle of said tool blade with respect to said grinding surface.

2. The electronic indicator of claim 1, wherein said tool rest has a leading edge, and the microprocessor (1) identifies said leading edge in terms of said first plane based on a known geometry of said tool rest, and (2) calculates a tool rest air gap according to a distance between the identified leading edge and said intersection.

3. The electronic indicator of claim 2, wherein said microprocessor compares said tool rest air gap to a specified maximum gap, and said electronic display indicates a result of such comparison.

4. The electronic bevel angle indicator of claim 1, wherein said microprocessor includes a memory in which said radius is stored, and said electronic display includes a user interface permitting a user to modify the stored radius.

5. The electronic bevel angle indicator of claim 4, wherein said electronic display displays said stored radius during a mode of operation in which said user is permitted to modify said stored radius.

6. The electronic bevel angle indicator of claim 1, wherein said sensing means senses a radius of said grinding wheel.

* * * * *